US006517162B2

(12) United States Patent
Cheng

(10) Patent No.: US 6,517,162 B2
(45) Date of Patent: Feb. 11, 2003

(54) SALON SHAMPOO CHAIR

(76) Inventor: Hsien-Yang Cheng, No. 168, Hsi-Lo Chen, Yun-Lin Hsien (TW)

( * ) Notice: Subject to any disclaimer, the term of this patent is extended or adjusted under 35 U.S.C. 154(b) by 0 days.

(21) Appl. No.: 09/843,805

(22) Filed: Apr. 30, 2001

(65) Prior Publication Data

US 2002/0158502 A1 Oct. 31, 2002

(51) Int. Cl.[7] ..... A47C 7/00

(52) U.S. Cl. ..... 297/440.14; 297/452.2; 297/452.65; 297/451.13; 297/451.8; 297/182; 4/515

(58) Field of Search ..... 297/440.14, 440.1, 297/440.24, 452.18, 452.2, 452.65, 182, 451.13, 451.8, 448.1; 4/515, 516, 517, 518, 519, 523

(56) References Cited

U.S. PATENT DOCUMENTS

| | | | | | |
|---|---|---|---|---|---|
| 3,201,172 | A | * | 8/1965 | Bliss | 297/448.1 |
| 3,224,810 | A | * | 12/1965 | Jenninges et al. | 297/451.1 |
| 3,669,496 | A | * | 6/1972 | Chisholm | 297/451.13 X |
| 3,810,673 | A | * | 5/1974 | Shoji | 297/217 |
| 3,841,703 | A | * | 10/1974 | Lowe | 297/452.65 X |
| 4,167,048 | A | * | 9/1979 | Williams | 4/523 |
| 4,240,662 | A | * | 12/1980 | Anderson | 297/17 |
| 4,841,584 | A | * | 6/1989 | Overcash et al. | 4/519 |
| 6,296,310 | B1 | * | 10/2001 | Laudenslayer et al. | 297/344.19 |

FOREIGN PATENT DOCUMENTS

| | | | | |
|---|---|---|---|---|
| DE | 2359266 | * | 8/1975 | 297/182 |
| GB | 1313967 | * | 4/1973 | 297/451.1 |
| IT | 634930 | * | 2/1962 | 297/451.1 |

* cited by examiner

*Primary Examiner*—Laurie K. Cranmer
(74) *Attorney, Agent, or Firm*—Bacon & Thomas, PLLC

(57) ABSTRACT

A salon shampoo chair. The shampoo chair includes a barrel-shaped main frame, a seat and a basin mounted on the main frame and a selected number of foot stands fastened directly to a lower side of the main frame. The shampoo chair is sturdy and easy to assemble and disassemble.

5 Claims, 5 Drawing Sheets

PRIOR ART Fig. 1

SALON SHAMPOO CHAIR

BACKGROUND OF THE INVENTION

This invention relates to an improved, salon shampoo chair that has a barrel type main frame mounted on foot stands to form a sturdy structure for supporting a seat and a basin and to facilitate assembly and disassembly.

The commonly used salon shampoo chairs at present include the earlier detachable type and a more fashionable integrated type. The detachable type has separated seat and basin. The basin is stationary and the seat is bulky. It occupies a relatively large space. It is not flexible to use or arrange in a given space. The integrated type has integrated seat and basin (as shown in FIG. 1). The shampoo chair A generally includes a seat A2 and a main frame A1 containing a basin A3.

The integrated shampoo chair generally has a smaller size than the separated shampoo chair, and is more convenient and flexible to use. The integrated shampoo chair also may adapt modern design easier to fit space layout requirement, and is easier to move and transport when the beauty parlor is relocated or renovated.

However the, main frame of the integrated shampoo chair is mostly made of porcelain which is bulky and heavy. It takes a lot of effort and care to move and transport, and tends to get damage easily when hit during moving. Contemporary design trend for all kinds of products heavily focuses on convenience and flexibility. In this perspective, there is still room for improvement on the design and construction of the salon shampoo chair.

SUMMARY OF THE INVENTION

The primary object of this invention is to provide an integrated salon shampoo chair that is easy to assemble and disassemble, and is flexible to make configuration arrangement to suit different space requirement, and is convenient to move and transport.

Another object of this invention is to reduce the production and transportation cost of the integrated salon shampoo chair and to prevent damage during transportation.

BRIEF DESCRIPTION OF THE DRAWINGS

The invention, as well as its many advantages, may be further understood by the following detailed description and drawings, in FIG. 1 is a perspective view of a conventional salon-shampoo chair.

DETAILED DESCRIPTION OF THE PREFERRED EMBODIMENT

Figure 1:
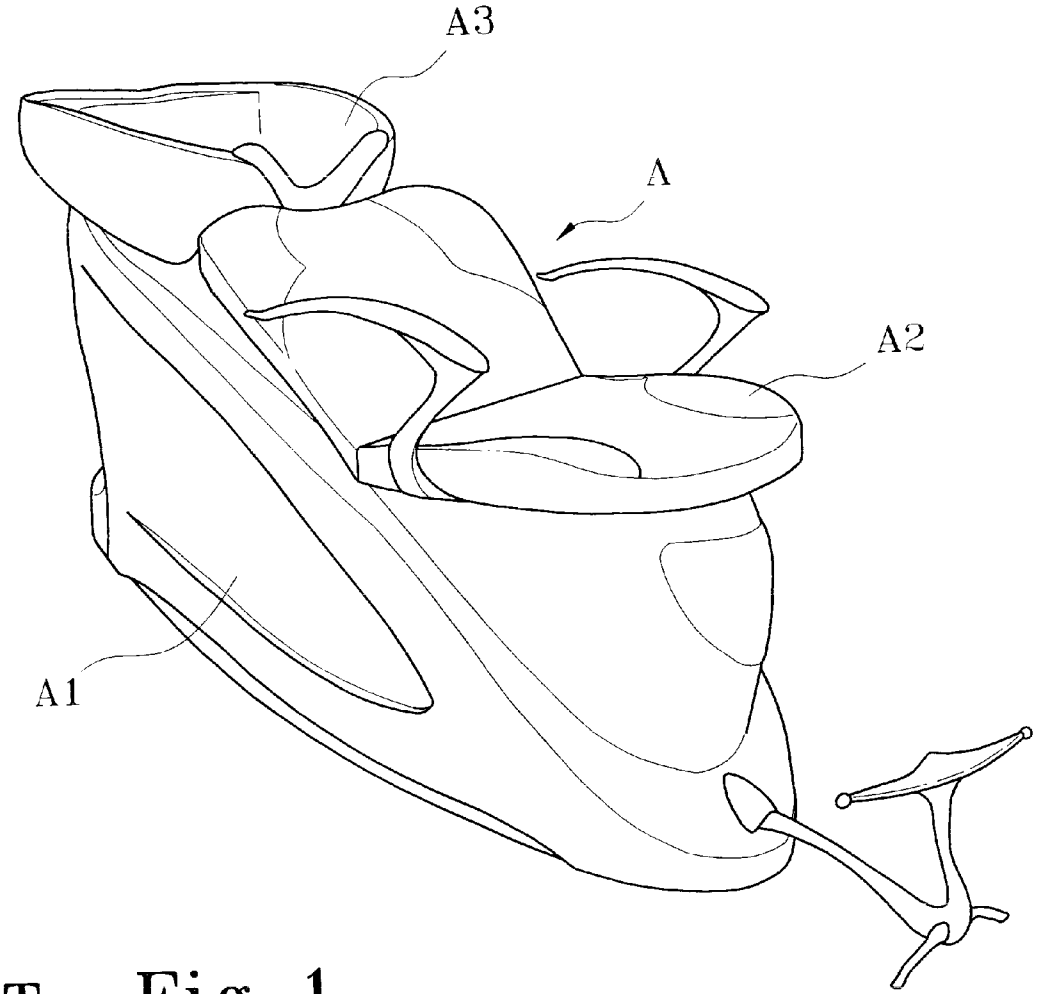
Figure 2:
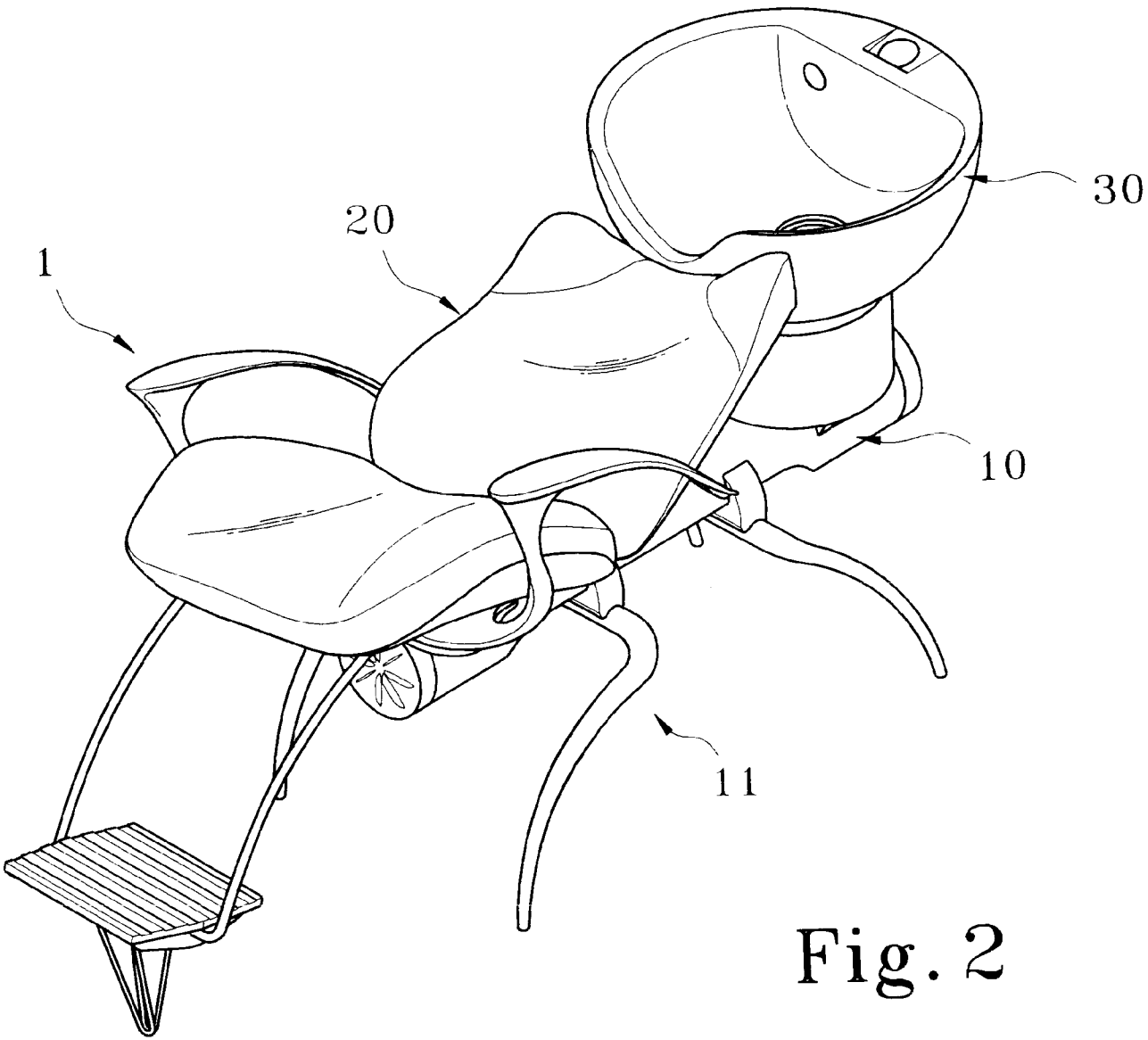
FIG. 2 is a perspective view of this invention.
Figure 3:
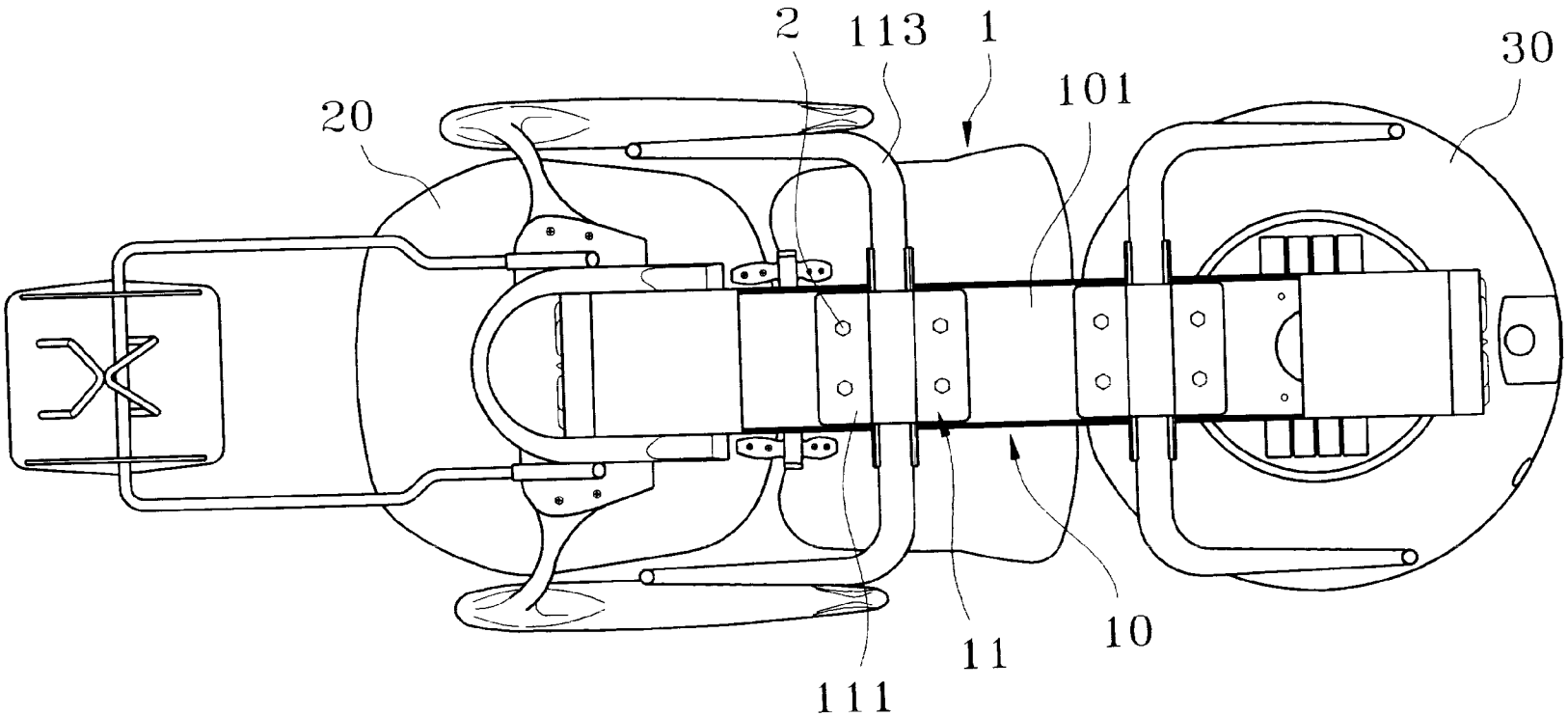
FIG. 3 a bottom view of this invention.

Referring to FIGS. 2 and 3, the salon shampoo chair 1 according to this invention includes a main frame 10 substantially formed in a barrel shape and a seat 20 and a basin 30 mounted on the main frame 10.

Below the main frame 10, there are a selected number of foot stands 11 fastened to the lower side of the mainframe 10 for forming a sturdy structure that is easy to assemble and disassemble.

Figure 4:
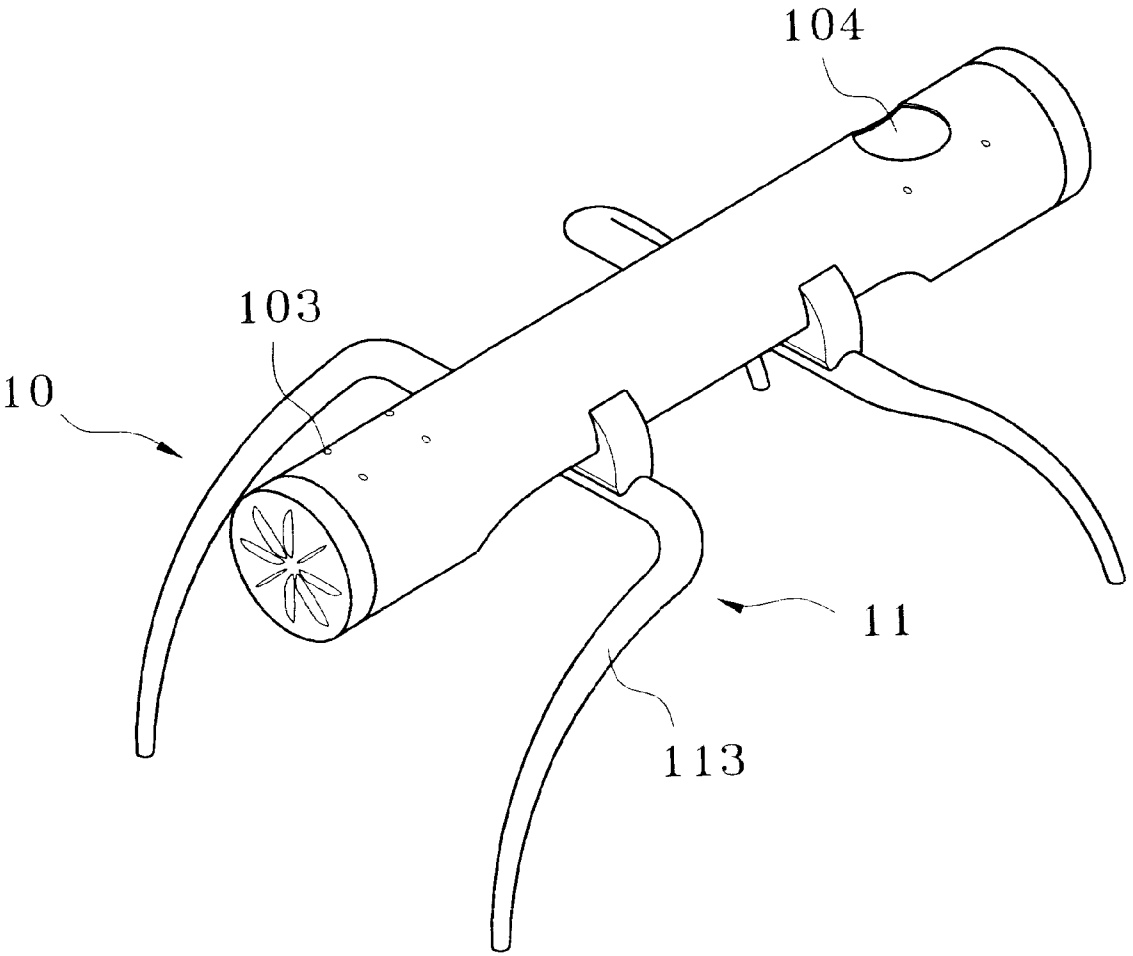
FIG. 4 is a perspective view of the main frame of this invention.
Figure 5:
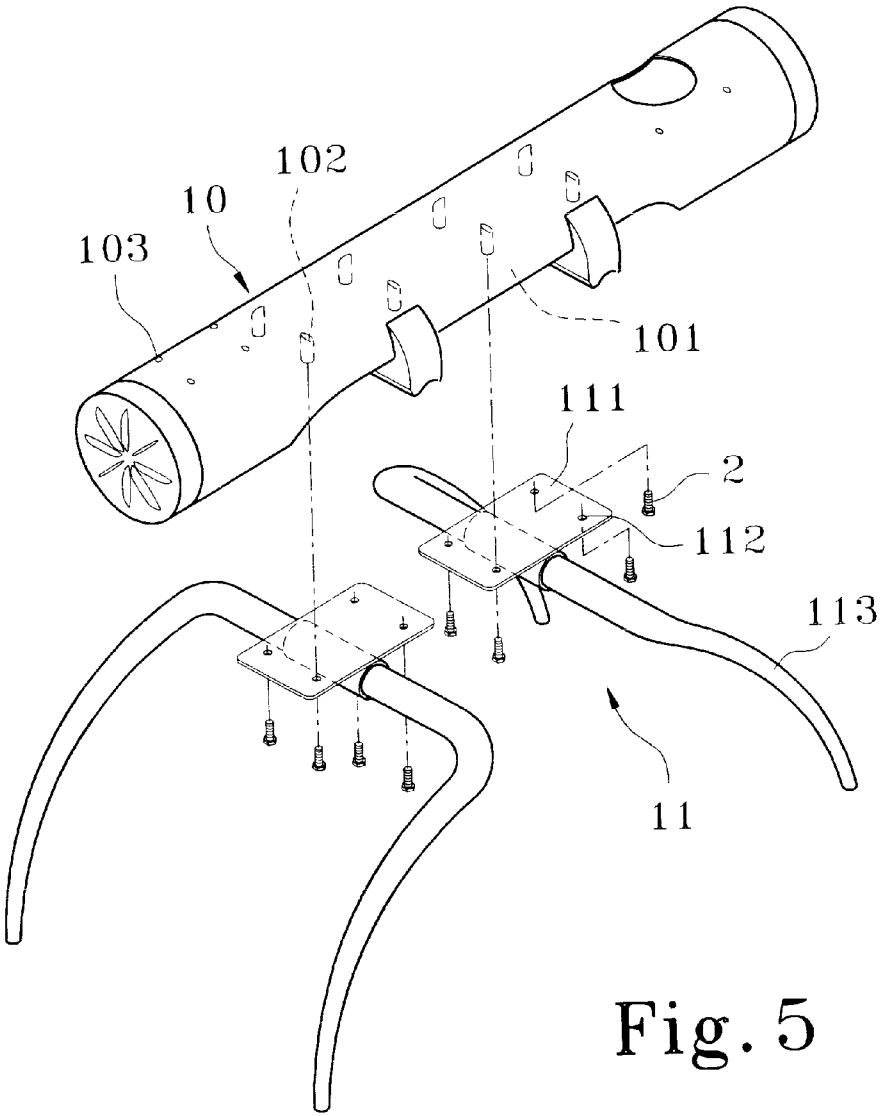
FIG. 5 is an exploded view of the main frame of this invention.

Referring to FIGS. 4 and 5, the main frame 10 has a hollow interior 101, a selected number of screws bores 103 formed thereon for fastening to the seat 20 and basin 30, and a through opening 104 for holding a discharge pipe (not shown in the drawings) of the basin 30. Inside the hollow interior 101, there are a selected number of fastening struts 102 which has external or internal screw threads.

The foot stand 11 includes a fastening plate 111 which has one side soldered or fastened to curved legs 113 which extend at two sides. The fastening plate 111 has apertures 112 mating against the fastening struts 102, and may be engaged with the fastening struts 102 through fasteners 2 such as screw nuts or bolts for fastening the foot stand 11 securely to the main frame 10 to form the salon shampoo chair 1.

When there is a need for disassembly, disengage the fasteners 2 from the fastening struts 102, the shampoo chair 1 may be dismembered into selected pieces for moving and transportation.

As the shampoo chair of this invention constitutes a barrel-shaped main frame with the seat and basin mounted thereon, and the main frame is supported by a selected number of foot stands, it is sturdily constructed and easy to assemble and disassemble.

By means of aforesaid construction, the shampoo chair of this invention may be integrally built and is easy to assemble and disassemble to facilitate transportation, and may be flexibly adapted to various arrangement to suit specific space requirements. It also has a lower production and transportation cost. The hitting damage that might otherwise happen during transportation may also be avoided.

While the preferred embodiment of the invention has been set forth for purpose of disclosure, modifications of the disclosed embodiment of the invention as well as other embodiments thereof may occur to those skilled in the art. Accordingly, the appended claims are intended to cover all embodiments which do not depart from the spirit and scope of the invention.

What is claimed is:

1. An improved salon shampoo chair, comprising:

a main frame having a hollow interior, a selected number of screw bores and a through opening formed thereon;

a seat and a basin fastened to an upper side of the main frame at the screw bores thereof, the basin positioned above the through opening of the main frame;

a plurality of foot stands fastened to a lower side of the main frame; and the hollow interior of the main frame includes a plurality of fastening struts located therein adapted to fasten the main frame to the foot stands, and the fastening struts extending into the interior of the main fame.

2. The improved shampoo chair of claim 1, wherein the fastening struts have external or internal screw threads.

3. The improved salon shampoo chair of claim 1, wherein the foot stands have curved legs extended at two sides thereof and a fastening plate which has one side soldering or fastening to the legs.

4. The improved salon shampoo chair of claim 3, wherein the fastening plate has apertures mating and engaged with the fastening struts through a selected number of fasteners.

5. The improved salon shampoo chair of claim 4, wherein the fasteners are screw nuts or bolts.

* * * * *